US005193478A

United States Patent [19]

Mardikian

[11] Patent Number: 5,193,478

[45] Date of Patent: Mar. 16, 1993

[54] ADJUSTABLE BRAKE AND CONTROL FLAPS FOR WATERCRAFT

[75] Inventor: Albert Mardikian, Corona Del Mar, Calif.

[73] Assignee: Mardikian 1991 Irrevocable Trust, Corona Del Mar, Calif.

[21] Appl. No.: 843,502

[22] Filed: Feb. 28, 1992

Related U.S. Application Data

[63] Continuation-in-part of Ser. No. 582,523, Sep. 14, 1990, Pat. No. 5,092,260.

[51] Int. Cl.[5] ..... B63B 1/22

[52] U.S. Cl. ..... 114/286; 114/145 A

[58] Field of Search ..... 114/284–287, 114/145 A

[56] References Cited

U.S. PATENT DOCUMENTS 3,058,442 10/1962 Curtis ..... 114/285

3,435,795 4/1969 Eckfield ..... 114/286

4,961,396 10/1990 Sasagawa ..... 114/285

FOREIGN PATENT DOCUMENTS 60-125457 6/1985 Japan ..... 114/286

*Primary Examiner*—Jesus D. Sotelo

*Attorney, Agent, or Firm*—Klein & Szekeres

[57] ABSTRACT

A system for trimming, steering and braking a watercraft includes a retractable plate or flap disposed on each lateral side of the hull of the watercraft. Each flap is extendible into the water, rearwardly in a continuously adjustable manner, and independently of the extension of the other flap. When the flap is fully extended then its angular position relative to the hull is also continuously adjustable independently of the angular positioning of the other flap. The flaps in their fully declined position act as powerful brakes for the watercraft. Differential extension of the flaps or differential adjustment of their relative angular positions on the two sides of the watercraft results in trimming and steering of the watercraft.

18 Claims, 3 Drawing Sheets

FIG.8
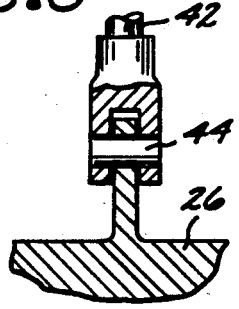
FIG.9
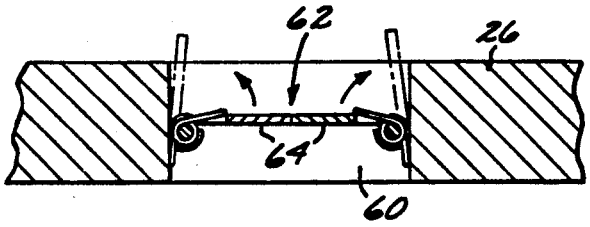
FIG.10
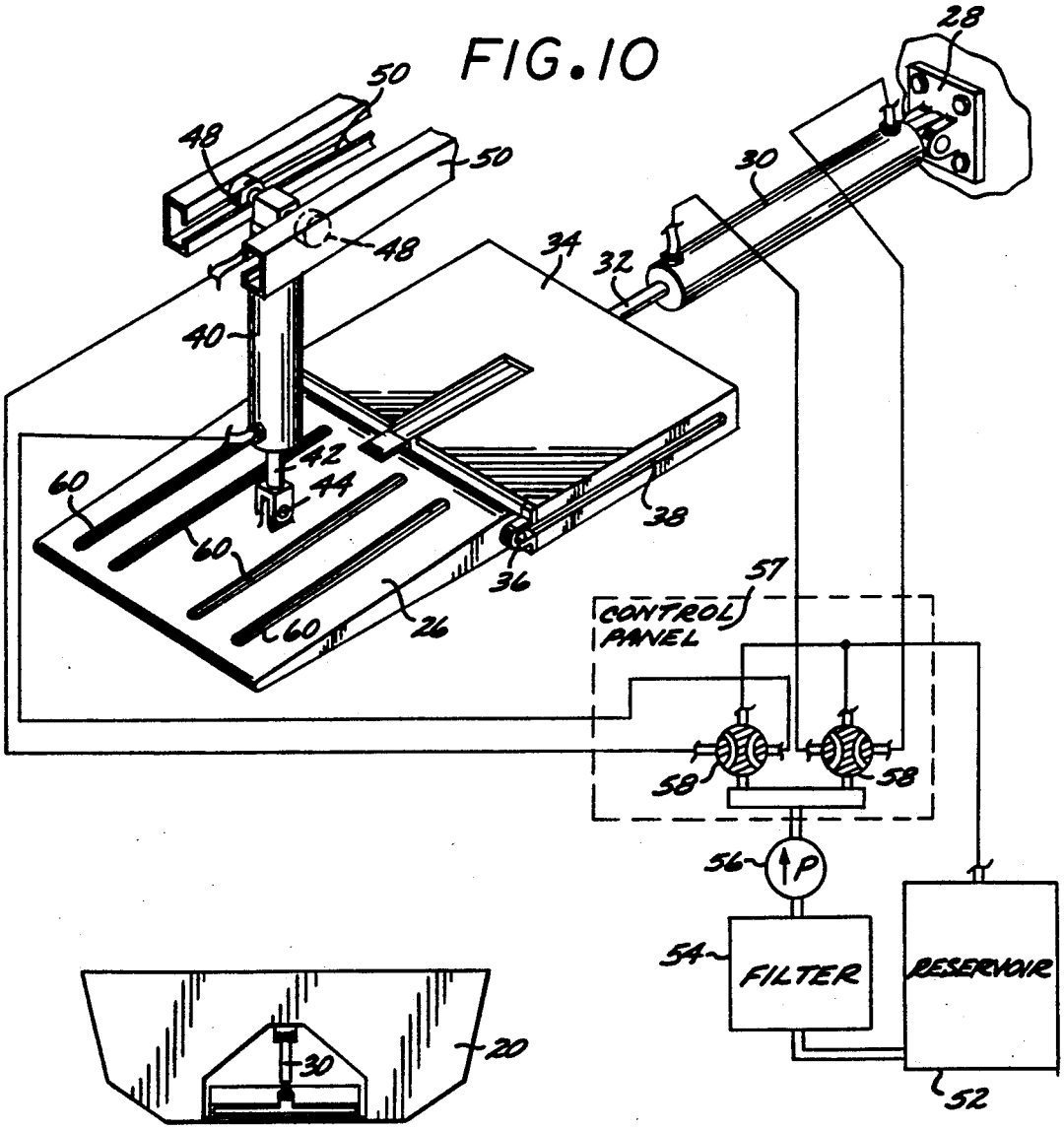
FIG.11

ADJUSTABLE BRAKE AND CONTROL FLAPS FOR WATERCRAFT

CROSS-REFERENCE TO RELATED APPLICATION

The present application is a continuation-in-part of application Ser. No. 582,523 filed on Sep. 14, 1990 which will issue as U.S. Pat. No. 5,092,260 on Mar. 3, 1992.

BACKGROUND OF THE INVENTION

1. Field of the Invention

The present invention is in the arts pertaining to boats and ships. More particularly the present invention is directed to trimming, steering and braking devices for water going vehicles.

2. Brief Description of the Prior Art

Trimming devices for boats and small watercraft (such as personal watercraft) have been known in the art, and are described, for example, in U.S. Pat. Nos. 3,435,795, 4,961,396, 3,058,442 and in Japanese Patent Application No. 60-125457. Generally speaking, the trimming devices of the prior art comprise a plate, the angular positioning of which is adjustable, and the presence of the plate influences the hydrodynamic forces acting on a boat or ship in motion on the water. As far as the present inventor is aware, however, the prior art has not provided such adjustable control and brake flaps system for a boat or ship which is capable of trimming, steering and braking the boat as well. The present invention provides such a flap system.

SUMMARY OF THE INVENTION

It is an object of the present invention to provide an adjustable trim and flap system for a boat or ship which is capable of operating as a trimming device and also as a braking device.

It is another object of the present invention to provide an adjustable trim and flap system for a boat or ship which is capable of operating as a trimming device and also as a steering device.

The foregoing objects and advantages are attained by a system which is incorporated into a boat or ship, and which comprises a retractable plate or flap disposed on each lateral side of the hull of the boat or ship. Each flap is extendible into the water, rearwardly in a continuously adjustable manner, and independently of the extension of the other flap. When the flap is fully extended then its angular position relative to the hull is also continuously adjustable independently of the angular positioning of the other flap. The flaps in their fully declined position act as powerful brakes for the boat or ship. Differential extension of the flaps or differential adjustment of their relative angular positions on the two sides of the boat results in trimming and steering of the boat.

The features of the present invention can be best understood together with further objects and advantages by reference to the following description, taken in connection with the accompanying drawings, wherein like numerals indicate like parts.

BRIEF DESCRIPTION OF THE DRAWINGS

FIG. 8 is a cross-sectional view taken on lines 8,8 of FIG. 4;

FIG. 9 is a cross-sectional view taken on lines 9,9 of FIG. 4;

FIG. 10 is a schematic perspective view showing the first preferred embodiment of the brake and control flap system of the present invention; and FIG. 11 is a schematic plan view of the rear of a boat which incorporates the second preferred embodiment of the brake and control flap system of the present invention.

DESCRIPTION OF THE PREFERRED EMBODIMENTS

The following specification taken in conjunction with the drawings sets forth the preferred embodiments of the present invention. The embodiments of the invention disclosed herein are the best modes contemplated by the inventor for carrying out his invention in a commercial environment, although it should be understood that various modifications can be accomplished within the parameters of the present invention.

Figure 2:
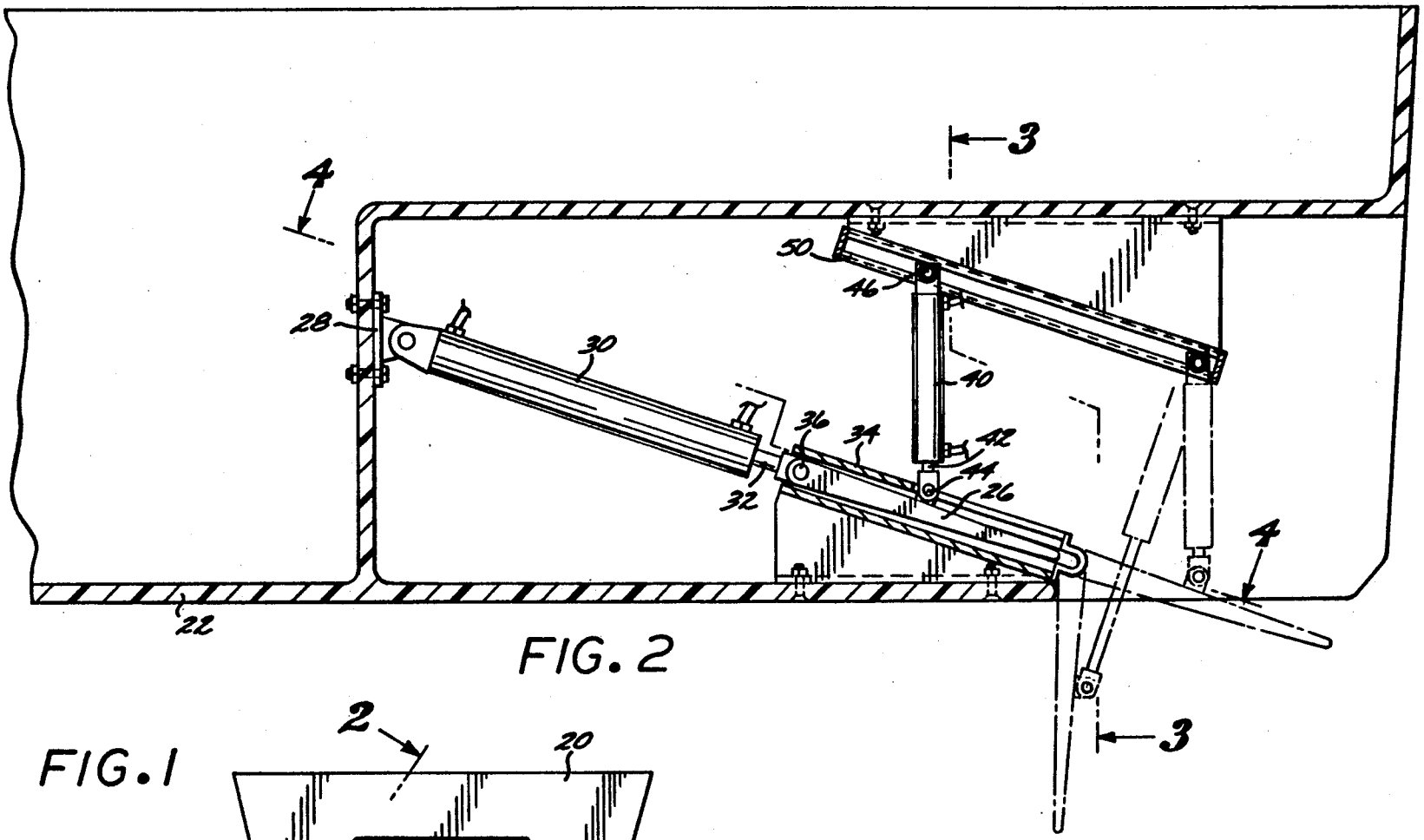
FIG. 2 is a cross-sectional view taken on lines 2,2 of FIG. 1.
Figure 1:
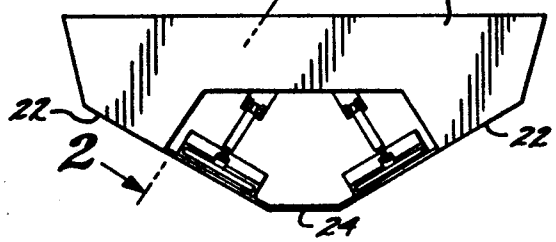
FIG. 1 is a schematic plan view of the rear of a boat which incorporates the first preferred embodiment of the brake and control flap system of the present invention.
Figure 3:
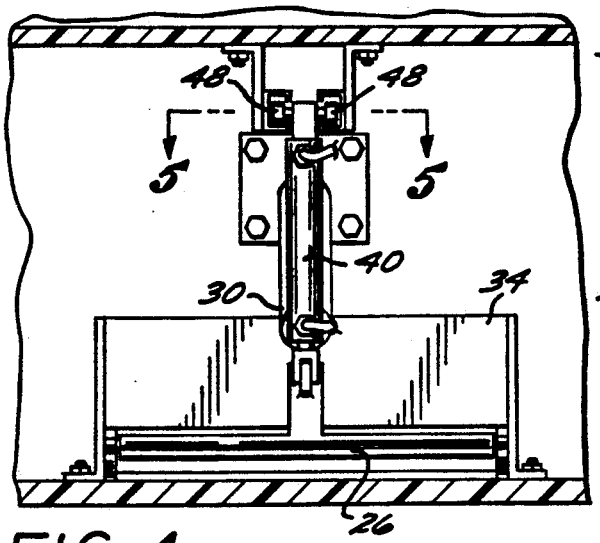
FIG. 3 is a cross-sectional view taken on lines 3,3 of FIG. 2.
Figure 5:
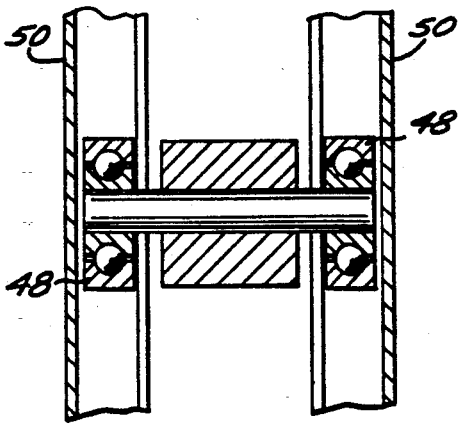
FIG. 5 is a cross-sectional view taken on lines 5,5 of FIG. 3.
Figure 4:
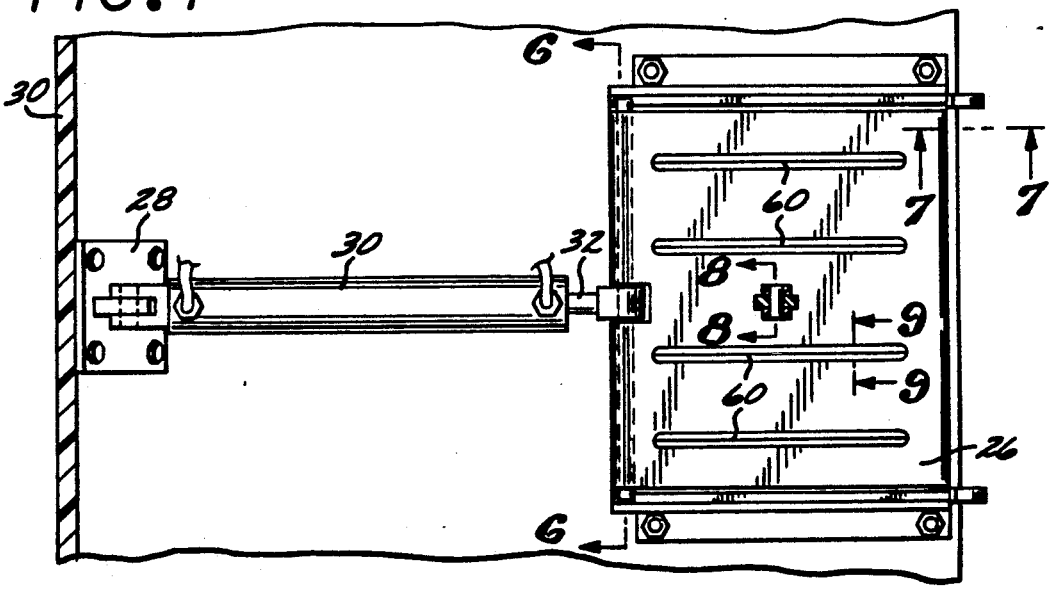
FIG. 4 is a cross-sectional view taken on lines 4,4 of FIG. 2.
Figure 6:
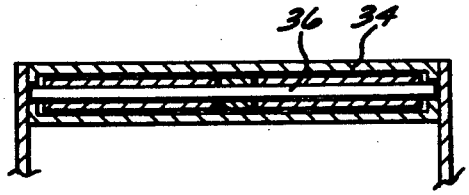
FIG. 6 is a cross-sectional view taken on lines 6,6 of FIG. 4.
Figure 7:
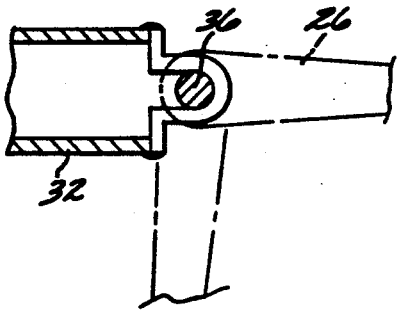
FIG. 7 is a cross-sectional view taken on lines 7,7 of FIG. 4.

Referring now to the drawing figures, and more particularly to FIGS. 1, 2 and 10, a first preferred embodiment of the brake and control flap system of the present invention is disclosed. Specifically, FIG. 2 schematically shows the hull 20 of a watercraft (boat or ship) into which the brake and control flap system of the present invention is incorporated. The hull 20 is substantially U-shaped, having two converging sides 22 and a substantially horizontal flat bottom 24. The first preferred embodiment of the brake and control flap system of the present invention is incorporated into the two converging sides 22, although it should be expressly understood that the invention is not limited by the shape of the hull 20.

Referring now primarily to FIG. 2, each side 22 of the hull 20 has an opening or compartment into which an extendible and angularly adjustable flap 26 and its activating mechanism is mounted. Thus, a bracket 28 mounted to a substantially vertical wall 30 in the hull 20 attaches a hydraulic cylinder 30 which has a piston 32 attached to one end of the flap 26. The flap 26 is mounted in a housing 34 which forms a track allowing the flap 26 to extend outwardly, or to be retracted into the housing 34 under the action of the hydraulic cylinder 30 and piston 32. The flap 26 is mounted into a bearing at the end of the piston 32 on a pivot axle 36, and the pivot axle 36 slides in slots 38 formed in the edge of the housing 34. This is best shown on FIG. 10.

Because the housing 34 and flap 26 are mounted at an angle relative to the horizontal, extension of the flap 26 creates a hydrofoil which, in turn, affects the hydrodynamic forces acting on the watercraft when the watercraft is in motion. The hydraulic cylinder 30 and piston 32 are of the type in which the position of the piston 32 can be remotely controlled, and in accordance with the present invention the hydraulic cylinder 30 and piston 32 on each side 22 of the hull 20 is independently controllable by an operator (not shown). In other words, the degree of extension/retraction of each flap 26 is independently controllable by the driver (not shown) of the watercraft through a hydraulically actuated servo mechanism. Such servo mechanisms per se are well known in the art, and need not be described here in detail. Instead of a hydraulically activated servo mechanism a servo mechanism actuated by compressed air, or a purely electric servo mechanism can also be used.

Referring again primarily to FIGS. 1 and 10, a substantially vertically disposed hydraulic cylinder 40 and piston 42 are shown. The lower end of the vertical piston 42 is attached to the flap 26 through an axle 44. The upper end of the cylinder 40 is mounted to another axle 46. The axle 46 is mounted in bearings 48 which ride in a track 50 attached to the hull 20. It should be readily apparent from the foregoing description and inspection of the drawing figures that when the servo mechanism formed by the hydraulic cylinder 30 and piston 32 extends or retracts the flap, the hydraulic cylinder 40 and piston 42 are carried by and move together with the flap 26. Position of the piston 42 in the hydraulic cylinder 40 of each flap 26 is controlled by the operator/driver of the boat or ship. In other words, the hydraulic cylinder 40 and piston 42 form a second and independent servo mechanism for each flap 26. Thus, when the flap 26 is fully extended, then the angular positioning of the flap 26 is controllable by this second servo mechanism. FIG. 2 shows with solid lines the flap 26 in a fully retracted position, and with a first set of phantom lines the flap 26 fully extended but without changing its angular position relative to the position it occupies when retracted in the housing 34. FIG. 2 also shows with a second set of phantom lines the flap 26 fully deflected downwardly, as a result of full extension of the piston 42 in the second servo mechanism. Although this is not specifically shown on the drawing figures, in accordance with the present invention the flap 26 can also be deflected upwardly, in a direction opposite the one shown on FIG. 2.

Operation of the flap 26 on one side 22 of the hull 20 is schematically illustrated in FIG. 10. Thus, a reservoir 52 provides the hydraulic fluid which may be filtered in a filter system 54 and kept under pressure by a pump 56. The position of the pistons in the cylinders is controlled from a control panel 57 by the driver (not shown) through an appropriate valve, (and optionally electric) system, which is symbolized on FIG. 10 by the schematic depiction of the valves 58. It is an important feature of the present invention that both the extension and angular positioning of the flap 26 on each side 22 of the hull 20 is controllable independently from the other. Accordingly, uneven extension and/or angular adjustment of the flap 26 on one side of the hull 20 can trim the boat or ship to compensate for uneven distribution of weight on the boat or ship. The flap 26 on one side of the hull 20 can be used for steering, either by itself or in conjunction with conventional steering mechanism (such as a rudder (not shown)) of the watercraft. Even extension and angular positioning of the flaps 26 on both sides of the hull 20 can also accomplish "trimming", to compensate for weight distribution in the fore and aft direction, or to cause the boat to ride differently. A negative (upward) deflection of the flaps 26, for example, creates a "vacuum-like" effect in the rapidly traveling boat and helps to avoid or ameliorate "porpoising" of the boat. A very important function of the flaps 26 is braking. A strong braking effect is achieved when the flaps 26 are deflected substantially to their full extent downwardly, so that the flap 26 is at approximately 90° angle, or close to 90° angle, relative to the direction of travel of the hull 20.

Referring now back again to the drawing figures, and primarily to FIG. 10, as an optional feature the flap 26 of the first preferred embodiment of the present invention incorporates a plurality of parallel disposed slots 60. Normally, water (not shown) cannot flow through the slots 60, because a safety valve 62 comprising two spring mounted plates 64 blocks the flow. This is best shown in FIG. 9. The spring tension controlling the plates 64 is adjusted in such a manner, that the safety valve 62 opens because the plates 64 move in the direction indicated by the arrows on FIG. 9 when the pressure on the safety valve 62 reaches and exceeds a predetermined value. In this manner, damage to the flaps 26 can be avoided. An example of the utility of the just described mechanism is when a speed boat traveling at a relatively high speed "applies the brakes" by fully extending and lowering the flaps 26 on both sides of the hull 20. In such a situation the initial pressure and force on the flaps 26 may be sufficiently high so that without the safety valves 62 mechanical damage could occur. In such a case, however the safety valves 62 open, the water "bleeds" through and excessive force and damage to the flaps 26 is avoided. As the boat slows down, the pressure on the safety valves 62 decreases, the valves 62 close and thereby increase the effectiveness of the flaps 26 as brakes. The opening and closing of the safety valve 62 may also affect the handling characteristics of the watercraft.

FIG. 11 illustrates a second preferred embodiment of the brake and control flap system of the present invention. In this embodiment only one extendible and angularly adjustable flap is incorporated into the bottom of the hull 20 of a boat or ship. The brake and control flap system of this second embodiment is suitable for fore and aft trimming of the watercraft, for adjustment into a negative angle to avoid "porpoising", and for effective braking by full extension and deflection of the flap 26.

Several modifications of the present invention may become readily apparent to those skilled in the art in light of the foregoing disclosure. Therefore, the scope of the present invention should be interpreted solely from the following claims, as such claims are read in light of the disclosure.

What is claimed is:

1. A watercraft comprising:

a hull including a bottom section;

a compartment formed in the bottom section of the hull;

a flap operatively mounted in the compartment;

first means for extending the flap in a continuously adjustable manner from the compartment into positions wherein the flap acts as a hydrofoil, the first means also capable of retracting the flap into the compartment into a retracted position wherein the flap does not act as a hydrofoil, and second means for continuously adjusting the angular positioning of the flap relative to the bottom of the hull whereby the angle at which the flap meets the water is adjusted, the flap acting as a brake for the watercraft in its substantially fully lowered position, said first and second means being controllable by the operator of the watercraft.

2. The watercraft of claim 1 where the first and second means are hydraulically actuated.

3. The watercraft of claim 1 where the first means comprise a hydraulically actuated piston and cylinder, the piston being connected to the flap, and wherein the position of the piston is controlled by the operator of the boat.

4. The watercraft of claim 1 where the second means comprise a hydraulically actuated piston and cylinder, the piston being connected to the flap, and wherein the position of the piston is controlled by the operator of the boat.

5. The watercraft of claim 1 where the flap incorporates a plurality of openings, and third means operatively incorporated in the openings for preventing water from passing through the opening when the hydrodynamic pressure of the water is below a threshold level, and for allowing water to pass through said openings when the hydrodynamic pressure exceeds the predetermined threshold level.

6. The watercraft of claim 5 where the third means comprise two spring loaded plates incorporated into the openings, the plates normally closing the gap in the opening unless the hydrodynamic pressure exceeds the predetermined threshold level.

7. The watercraft of claim 1 comprising a first track in which the flap moves under the action of the first means in a substantially fore and aft direction, and a second track in which the second means is carried by the flap.

8. The watercraft of claim 7 where the first and second means each comprise a hydraulically actuated cylinder and piston combination.

9. A watercraft comprising:

a hull;

a first and a second compartment formed in the right and left sides of the hull respectively, substantially at the same level in the fore and aft direction;

a first flap operatively mounted in the first compartment;

first means for extending the first flap of the first compartment in a continuously adjustable manner from the first compartment into positions wherein the first flap acts as a hydrofoil, the first means also capable of retracting the first flap into the first compartment into a retracted position wherein the first flap does not act as a hydrofoil;

second means for continuously adjusting the angular positioning of the first flap relative to the hull whereby the angle at which the first flap meets the water is adjusted, the first flap acting as a brake for the watercraft in its substantially fully lowered position;

a second flap operatively mounted in the second compartment;

third means for extending the second flap of the second compartment in a continuously adjustable manner from the second compartment into positions wherein the second flap acts as a hydrofoil, the third means also capable of retracting the second flap into the second compartment into a retracted position wherein the second flap does not act as a hydrofoil;

fourth means for continuously adjusting the angular positioning of the second flap relative to the bottom of the hull whereby the angle at which the second flap meets the water is adjusted, the second flap acting as a brake for the watercraft in its substantially fully lowered position, said first, second, third and fourth means each being independently controllable by the operator of the watercraft, whereby the extension and angular positioning of the first and second flaps can be utilized for trimming, steering and braking the watercraft.

10. The watercraft of claim 9 where the first, second, third and fourth means are hydraulically actuated.

11. The watercraft of claim 9 where each of the first, second, third and fourth means comprise a hydraulic servo mechanism, including a cylinder and a piston moving in said cylinder, the piston being connected to the respective flap, and wherein the position of the piston is controlled by the operator.

12. The watercraft of claim 11 where the first and second compartments each include a track into which the respective flap is mounted and in which the flap moves in a substantially fore and aft direction under action of the piston of the respective first and third means.

13. The watercraft of claim 12 where the first and second compartments each include another track into which the cylinder of the respective second and fourth means are mounted and in which said cylinder is carried by the flap.

14. The watercraft of claim 9 wherein each flap can be deflected under the action of the respective second and fourth means to occupy an angular position which is at substantially right angle relative to the forward motion of the watercraft, in said position the flap acting as brakes for the watercraft.

15. The watercraft of claim 9 wherein the hull of the watercraft is substantially U-shaped having two converging sides, and wherein each compartment having the flap is mounted on one of said converging sides.

16. The watercraft of claim 9 where each flap incorporates a plurality of openings, and fifth means operatively incorporated in the openings for preventing water from passing through the opening when the hydrodynamic pressure of the water is below a threshold level, and for allowing water to pass through said openings when the hydrodynamic pressure exceeds the predetermined threshold level.

17. The watercraft of claim 16 where the fifth means comprise two spring loaded plates incorporated into the openings, the plates normally closing the gap in the opening unless the hydrodynamic pressure exceeds the predetermined threshold level.

18. The Watercraft of claim 16 where the openings in the flaps are parallel disposed slots.

* * * * *